US011970922B2

(12) United States Patent
Brandsdal et al.

(10) Patent No.: US 11,970,922 B2
(45) Date of Patent: Apr. 30, 2024

(54) MULTI-CYCLE COUNTER SYSTEM

(71) Applicant: Nine Downhole Technologies, LLC, Houston, TX (US)

(72) Inventors: Viggo Brandsdal, Ytre Arna (NO); Geir Valestrand Aasheim, Ytre Arna (NO)

(73) Assignee: NINE DOWNHOLE TECHNOLOGIES, LLC, Houston, TX (US)

( * ) Notice: Subject to any disclaimer, the term of this patent is extended or adjusted under 35 U.S.C. 154(b) by 86 days.

(21) Appl. No.: 17/662,816

(22) Filed: May 10, 2022

(65) Prior Publication Data

US 2022/0356782 A1 Nov. 10, 2022

Related U.S. Application Data

(60) Provisional application No. 63/186,510, filed on May 10, 2021.

(51) Int. Cl.
*E21B 23/04* (2006.01)
*E21B 34/08* (2006.01)
*E21B 34/14* (2006.01)

(52) U.S. Cl.
CPC ..... *E21B 34/08* (2013.01); *E21B 23/0413* (2020.05); *E21B 23/042* (2020.05); *E21B 34/14* (2013.01)

(58) Field of Classification Search
CPC .... E21B 23/0413; E21B 23/04; E21B 23/042; E21B 34/14; E21B 34/142
See application file for complete search history.

(56) References Cited

U.S. PATENT DOCUMENTS

| | | | | |
|---|---|---|---|---|
| 10,280,702 | B2 * | 5/2019 | Graf | E21B 43/26 |
| 11,299,945 | B2 * | 4/2022 | Warlick | E21B 23/0412 |
| 2009/0272544 | A1 * | 11/2009 | Giroux | E21B 31/12 166/208 |
| 2010/0294514 | A1 * | 11/2010 | Crow | E21B 33/134 166/386 |
| 2012/0260999 | A1 * | 10/2012 | Brandsdal | E21B 34/10 251/12 |
| 2015/0218904 | A1 * | 8/2015 | Chauffe | E21B 33/129 166/54.5 |
| 2017/0342806 | A1 * | 11/2017 | Themig | E21B 33/12 |
| 2018/0334882 | A1 * | 11/2018 | Brandsdal | E21B 33/1208 |
| 2019/0195048 | A1 * | 6/2019 | Tveranger | E21B 34/10 |
| 2022/0081994 | A1 * | 3/2022 | Chevallier | E21B 34/063 |

* cited by examiner

*Primary Examiner* — Shane Bomar
(74) *Attorney, Agent, or Firm* — Morgan, Lewis & Bockius LLP

(57) ABSTRACT

The present disclosed technology relates to a downhole tool activation device, and a method of using the device, where the valve is configured to open when the counter device has moved an activation distance in an activation direction, a piston engaged with the counter device, having a wellbore pressure from a fluid source applied to a first side, and a pressure in a fluid reservoir applied to the second side, the piston configured to move a step distance in a first direction when the wellbore pressure exceeds the pressure in the fluid reservoir, and configured to move a step distance in an opposite direction driven solely by a greater pressure in the fluid reservoir than the wellbore pressure, and a flow restrictor in fluid communication with the fluid reservoir and fluid source, configured to restrict the flow of fluid between the fluid source to the fluid reservoir.

22 Claims, 17 Drawing Sheets

MULTI-CYCLE COUNTER SYSTEM

CROSS-REFERENCE TO RELATED APPLICATIONS

This Application claims the benefit of U.S. Provisional Application 63/186,510, entitled MULTI-CYCLE COUNTER SYSTEM, filed May 10, 2021, the contents of which are incorporated by reference as if fully set forth herein.

TECHNICAL FIELD

The present invention relates to a multi-cycle counter system for use in downhole tools.

BACKGROUND OF THE INVENTION

When drilling an oil well, there are several downhole tools that need to be activated after they are installed in a wellbore. For example, barrier devices may need to be opened, or closed. Other examples of downhole tools that can be activated include setting tools, sliding sleeves, toe valves, and tracer release tools. One method of activating such tools is by applying pressure to an inlet in a tool to cause the tool to be activated. While simple to activate, such systems have numerous problems. For example, pressure in a wellbore frequently fluctuates as drilling fluids are circulated, new tools are added, or the device is moved to a different depth with a different hydrostatic pressure. Additionally, some wellbore operations require application of high pressure, during which a user may not want the tool to activate. That is, there needs to be a way to ensure that a particular pressure rise or drop applied for another reason does not activate the tool.

One possible solution is a pressure counter system, configured to allow a user to apply a predetermined number of pressure cycles to the device to activate it. However, hydrostatic pressure presents another problem to such devices. As a tool moves to deeper depths in a well, the hydrostatic pressure increases. While a pressure applied from the surface will translate to a similar pressure change at other depths in the well, the absolute pressure can vary dramatically. As a result, it is difficult to determine what pressure needs to be applied from the surface to create a sufficient pressure at the downhole tool to activate it.

There is therefore a need for an improved multi-cycle counter system to allow a downhole tool to be activated after a predetermined number of pressure cycles where hydrostatic pressure is accounted for in the tool activation. There is further a need for such an improved multi-cycle counter system that includes a few number of moving parts. There is a further need for a such an improved multi-cycle counter system to reliably apply pressure to a pressure-activated downhole tool when activated.

It is an objective of the present invention to meet this need and to provide further advantages over the state of the art.

BRIEF SUMMARY

It is an object of the present invention to mitigate, alleviate or eliminate one or more of the above-identified deficiencies and disadvantages in the prior art and solve at least the above mentioned problems.

Aspects of the present disclosed technology relate to a downhole tool activation device, comprising a valve disposed between a pressurized fluid and an activation port, a counter device connected to the valve, wherein the valve is configured to open when the counter device has moved an activation distance in an activation direction, a piston engaged with the counter device, having a wellbore pressure from a fluid source applied to a first side, and a pressure in a fluid reservoir applied to the second side, the piston configured to move a step distance in a first direction when the wellbore pressure exceeds the pressure in the fluid reservoir, and configured to move a step distance in an opposite direction driven solely by a greater pressure in the fluid reservoir than the wellbore pressure, a flow restrictor in fluid communication with the fluid reservoir and fluid source, configured to restrict the flow of fluid between the fluid source to the fluid reservoir.

In some embodiments, the flow restrictor is further configured to allow a pressure applied to the wellbore fluid to move the piston the step distance in the first direction before sufficient fluid passes through the flow restrictor to equalize the pressure between the fluid source and the fluid reservoir, and allow the piston to move the step distance in the opposite direction when the pressure is released from the wellbore fluid before sufficient fluid passes through the flow restrictor to equalize the pressure between the fluid source and the fluid reservoir. In some embodiments, the fluid source is a second fluid reservoir separated from the wellbore fluid by a barrier configured to allow pressures applied to the wellbore fluid to be transmitted by the barrier to the second fluid reservoir. In some embodiments, a fluid in the fluid reservoir and the second fluid reservoir has a higher compressibility than the wellbore fluid. In some embodiments, the valve is a pin valve, and wherein the pathway is selectively blocked by a pin such that when the pin is removed from the pin valve, the pressurized fluid can pass through the pin valve to the activation port. In some embodiments, the pin is connected to the counter device, and wherein the pin is removed from the pin valve when the counter device has moved the activation distance. In some embodiments, the step distance is half the activation distance or less. In some embodiments, the counter device is a ratchet rod having a plurality of ratchet teeth, the piston having a first ratchet gripping device allowing the ratchet rod to travel only one direction relative to the piston, and a second ratchet gripping device fixed relative to the downhole tool, allowing the ratchet rod to travel only one direction through the second ratchet gripping device. In some embodiments, the ratchet rod is moved a distance greater than or equal to the length of a ratchet tooth on the ratchet rod when the piston is moved the step distance. In some embodiments, the movement of the piston in the first direction and opposite direction is limited by travel stops.

Aspects of the disclosed technology also relate to a method of using a downhole tool activation device, and wherein the downhole tool activation device comprises a valve disposed between a pressurized fluid and an activation port, a counter device connected to the valve, wherein the valve is configured to open when the counter device has moved an activation distance in an activation direction, a piston engaged with the counter device, having a wellbore pressure from a fluid source applied to a first side, and a pressure in a fluid reservoir applied to the second side, the piston configured to move a step distance in a first direction when the wellbore pressure exceeds the pressure in the fluid reservoir, and configured to move a step distance in an opposite direction driven solely by a greater pressure in the fluid reservoir than the wellbore pressure, a flow restrictor in fluid communication with the fluid reservoir and fluid source, configured to restrict the flow of fluid between the fluid source to the fluid reservoir and wherein the method comprises: increasing the wellbore pressure, causing the pressure from the fluid source to move the piston the step distance in a first direction, lowering the wellbore pressure, causing the pressure from the fluid reservoir to move the piston the step distance in an opposite direction.

In some embodiments, after increasing the wellbore pressure, and/or after lowering the wellbore pressure, maintaining the wellbore pressure for a period of time sufficient to allow fluid to flow through the flow restrictor and equalize the pressure between the fluid reservoir and the fluid source. In some embodiments, the method is repeated a predetermined number of times until the counter device has moved the activation distance, causing the valve to open.

In some embodiments, the fluid source is a second fluid reservoir separated from the wellbore fluid by a barrier configured to allow pressures applied to the wellbore fluid to be transmitted by the barrier to the second fluid reservoir. In some embodiments, a fluid in the fluid reservoir and the second fluid reservoir has a higher compressibility than the wellbore fluid. In some embodiments, the valve is a pin valve, and wherein the pathway is selectively blocked by a pin such that when the pin is removed from the pin valve, the pressurized fluid can pass through the pin valve to the activation port. In some embodiments, the pin is connected to the counter device, and wherein the pin is removed from the pin valve when the counter device has moved the activation distance. In some embodiments, the counter device is a ratchet rod having a plurality of ratchet teeth, the piston having a first ratchet gripping device allowing the ratchet rod to travel only one direction relative to the piston, and a second ratchet gripping device fixed relative to the downhole tool, allowing the ratchet rod to travel only one direction through the second ratchet gripping device. In some embodiments, the ratchet rod is moved a distance greater than or equal to the length of a ratchet tooth on the ratchet rod when the piston is moved the step distance. In some embodiments, the step distance is half the activation distance, or less.

BRIEF DESCRIPTION OF THE FIGURES

Included in the present specification are figures which illustrate various embodiments of the present disclosed technology. As will be recognized by a person of ordinary skill in the art, actual embodiments of the disclosed technology need not incorporate each and every component illustrated, but may omit components, add additional components, or change the general order and placement of components. Reference will now be made to the accompanying figures and flow diagrams, which are not necessarily drawn to scale, where like numerals denote common features between the drawings, and wherein.

DETAILED DESCRIPTION

Figure 1:
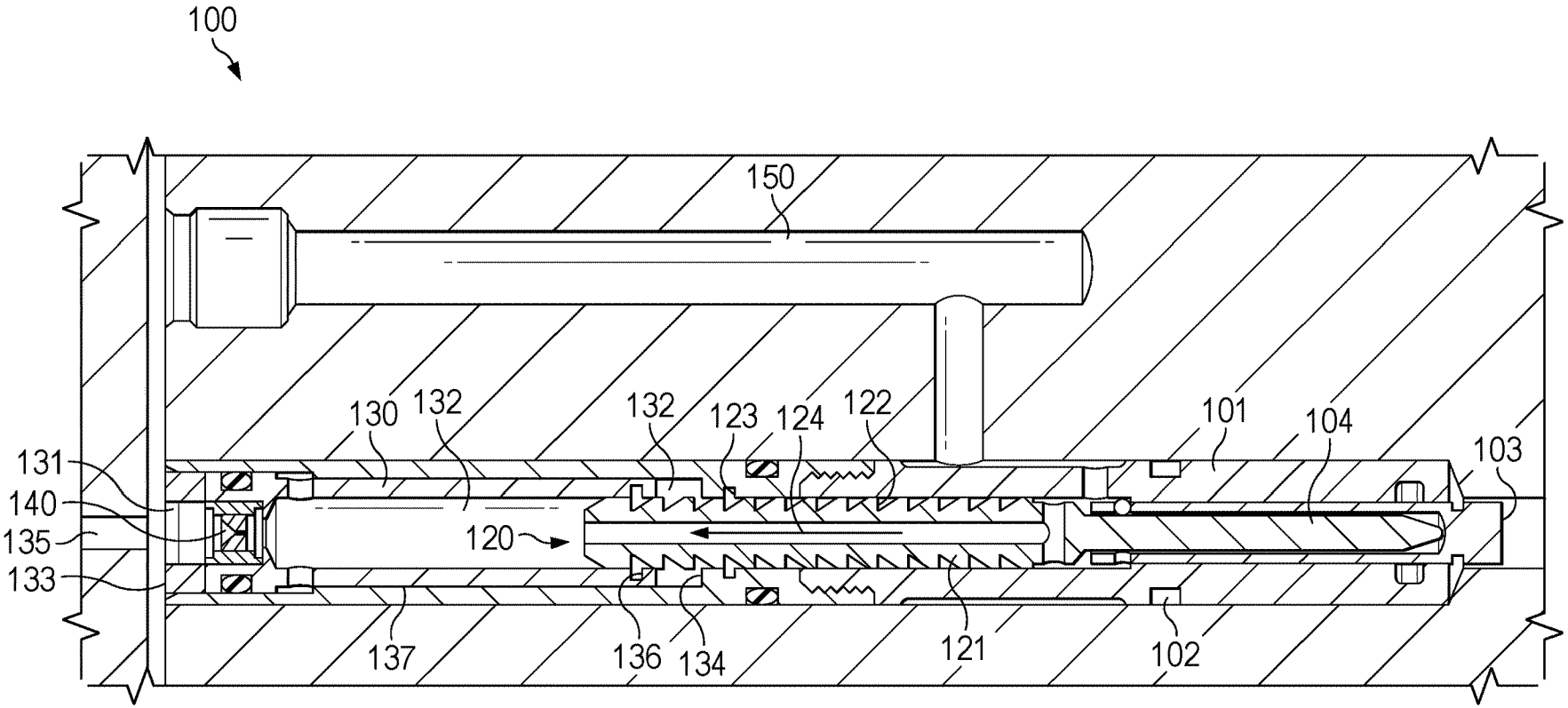
FIG. 1 depicts a multi-cycle counter system in accordance with an embodiment.

The present invention will now be described with reference to the accompanying drawings, in which preferred example embodiments of the invention are shown. The invention may, however, be embodied in other forms and should not be construed as limited to the herein disclosed embodiments. The disclosed embodiments are provided to fully convey the scope of the invention to the skilled person. Although example embodiments of the present disclosure are explained in detail, it is to be understood that other embodiments are contemplated. Accordingly, it is not intended that the present disclosure be limited in its scope to the details of construction and arrangement of components set forth in the following description or illustrated in the drawings. The present disclosure is capable of other embodiments and of being practiced or carried out in various ways.

It must also be noted that, as used in the specification and the appended claims, the singular forms "a," "an" and "the" include plural referents unless the context clearly dictates otherwise. Moreover, titles or subtitles may be used in this specification for the convenience of a reader, which have no influence on the scope of the present disclosure.

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

In describing example embodiments, terminology will be resorted to for the sake of clarity. It is intended that each term contemplates its broadest meaning as understood by those skilled in the art and includes all technical equivalents that operate in a similar manner to accomplish a similar purpose.

In the following detailed description, references are made to the accompanying drawings that form a part hereof and that show, by way of illustration, specific embodiments or examples. In referring to the drawings, like numerals represent like elements throughout the several figures.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

FIG. 1 describes a multi-cycle counter system 100 in accordance with an embodiment. The multi-cycle counter system includes a valve 101 disposed between a pressure source 102 and an activation port 103. The valve can further comprise a pin 104 located in a valve bore 105 that, when the pin is located in the wellbore, a fluid path between the pressure source 102 and activation port 103 is blocked, and when the pin is removed from the valve bore 105, allows fluid to pass through the valve. The pin valve 101 depicted in FIG. 1 is by way of illustration, and not limitation. As will be recognized by a person of ordinary skill, other valve designs and arrangements can be used with embodiments of the disclosed invention. Indeed, any valve configured or configurable to open when a component is moved a distance is capable of being used in accordance with embodiments.

The multi-cycle counter system 100 can comprise a counter device 120 connected to the valve 101. In some embodiments, the valve 101 is configured to open when the counter device 120 has moved an activation distance in an activation direction. In some embodiments, the counter device 120 can be a ratchet rod 121, having a plurality of ratchet teeth 122. The ratchet rod 121 can be configured to move relative to a first clip 123 having a fixed position relative to the valve 102. The first clip 123 permits the ratchet rod 121 to move in the activation direction 124, but not to move in an opposite direction.

The multi-cycle counter system 100 can further comprise a piston 130 connected to the counter device 120. The piston 130 can be configured to travel a step distance. The piston 130 can be configured to move a stroke distance as a result of a difference in pressure between a first volume 131 and a second volume 132. In some embodiments, the movement of the piston 130 can be constrained by a set of travel stops 133, 134. In some embodiments, the travel stops 133 and 134 can be adjustable inserts installed in the piston bore 137. In some embodiments, the first and second volumes 131, 132 can be connected by a flow restrictor 140. In some embodiments, the first volume 131 can be connected to a fluid source 135. The flow restrictor can act as a pressure time delay system between the first volume 131 and second volume 132.

When a pressure is applied to the first volume 131, the piston can be driven in a first direction, because the pressure in the first volume 131 is greater than the pressure in the second volume 132. If that pressure is held, fluid will flow through the flow restrictor 140 over time, bringing the pressure between the first and second volumes 131, 132 into equilibrium. In that equilibrium condition, there will be no net force on the piston 130, causing it to remain in position.

If the pressure applied to the first volume 131 is reduced, the piston will be driven in an opposite direction, because the pressure in the first volume 131 is lower than the pressure in the second volume 132. If that reduced pressure is held, fluid will flow through the flow restrictor 140 over time, bringing the pressure between the first and second volumes 131, 132 into equilibrium. In that equilibrium condition, there will be no net force on the piston 130, causing it to remain in position.

In this manner, the piston 130 can be cycled by applying a pressure to the first volume 131 and holding it until pressure in the first and second volumes 131, 132 equalize, and then reducing the pressure and holding it until the first and second volumes 131, 132 equalize again. The only force necessary to restore the piston to its initial position is the residual pressure in the second volume 132. No springs are necessary to provide a restoring force to the piston.

In some embodiments the piston 130 has a clip 136 which clips on to the counter system 120. The configuration of clip 136 of the piston 130 and clip 123 of the counter system 120 can operate together to move a component of the counter system 120 (such as a ratchet rod 121) in the activation direction 124. Where the counter system 120 comprises a ratchet rod 121, the clip 136 can engage with the ratchet teeth 122 of the ratchet rod 121. In this configuration, when the piston moves in the activation direction 124, the clip 136 pulls the ratchet rod 121 in the activation direction 124. Because the ratchet teeth 122 are angled on the side in the activation direction, the clip 123 on the counter system 120 allows the ratchet teeth 122 to slide through the clip 123 as the ratchet rod 121 moves in the activation direction 124.

Using this mechanism, the ratchet rod 121 can translate in the activation direction through repeated cycles of pressure applied from the fluid source 135.

While this embodiment has been described with a counter system using a ratchet rod 121, other similar mechanisms are contemplated by the disclosed technology. For example, the ratchet rod 120 can be replaced by a simple rod, and the clips 123, 136 can be replaced with mechanisms that provide a gripping force in a single direction. Indeed, any counter system 120 that comprises a component that moves in an activation direction can be used with embodiments of the disclosed technology.

In some embodiments, the fluid used by the downhole activation system 100 can be selected to be a compressible fluid, such as a gas, or a liquid having a higher compressibility than the fluid used in the wellbore. Fluids having relatively high compressibility can provide advantages in accordance with embodiments, such as providing a shock-absorbing feature to the piston, increasing the amount of time it takes for pressure to equalize between the first and second volumes 131, 132. In some embodiments, the multi-cycle counter system 100 can further comprise a fluid reservoir 160 in fluid communication with the first or second volumes 131, 132. In the example depicted in FIG. 1, the fluid reservoir 160 is in fluid communication with the second volume 132. This fluid reservoir 160 can serve to increase the effective volume of the second volume 132. That is, because the fluid reservoir 160 is connected to the second volume 132, a larger volume of fluid must pass through flow restrictor 140 to equalize the pressure on both sides of the flow restrictor 140. This can also permit the multi-cycle counter system 100 to improve the reliability and functioning of the piston 130 by allowing the flow restrictor 140 to have a larger internal diameter. This can also improve the reliability of the flow restrictor by minimizing the possibility that the flow restrictor will become clogged by debris.

Figure 2A:
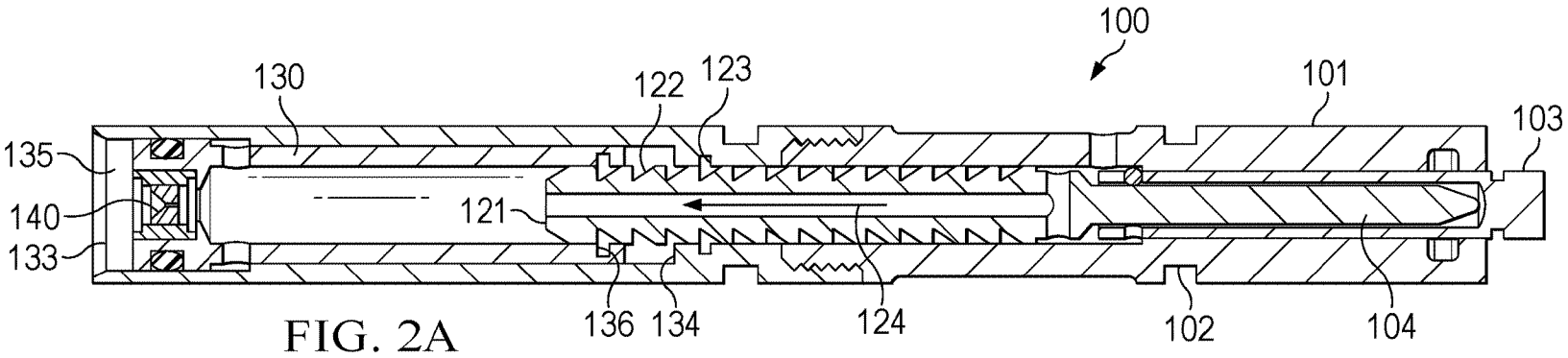
FIG. 2A depicts a multi-cycle counter system in accordance with an embodiment, with a piston at the end of a stroke distance in the activation direction.
Figure 2B:
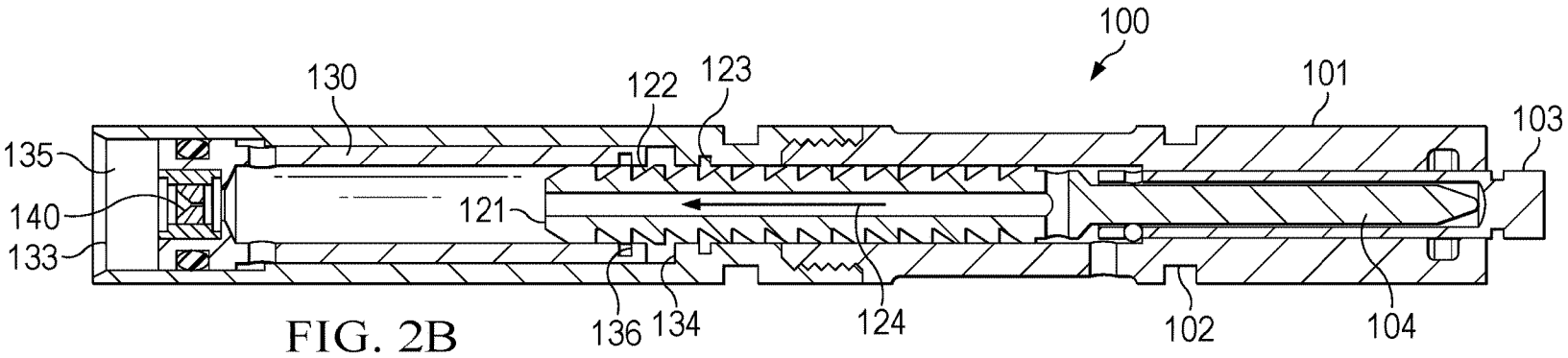
FIG. 2B depicts a multi-cycle counter system in accordance with an embodiment, with a piston in the middle of a stroke while moving in a direction opposite the activation direction.
Figure 2C:
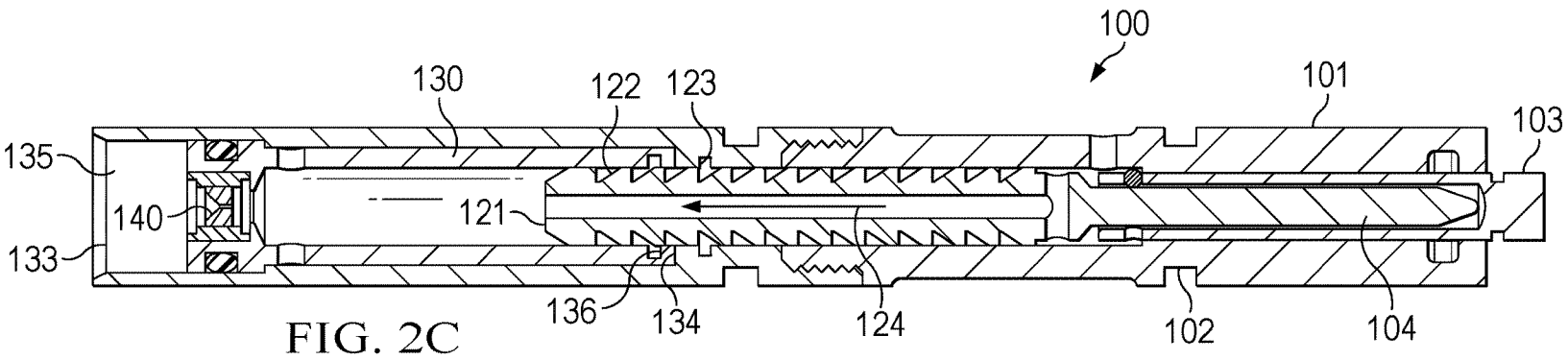
FIG. 2C depicts a multi-cycle counter system in accordance with an embodiment, with a piston at the end of a stroke distance in the direction opposite the activation direction.

FIGS. 2A-C depict an embodiment using a piston 130 and a ratchet rod 121 in use to move the ratchet rod 121 a step distance in the activation direction 124. FIG. 2A shows the piston 130 prior to movement, with the clips 123 and 136 engaged with ratchet rod 121. When an additional pressure is applied from the fluid source 135, the piston 130 will begin to move in a direction opposite the activation direction 124. FIG. 2B depicts the piston 130 in mid-stroke, showing that the clip 136 on the piston 130 slides over the ratchet tooth 122, while the clip 123 prevents the ratchet rod from moving in the direction opposite the activation direction 124. As depicted in FIG. 2C, the piston will come to rest when it reaches the travel stop 134. After a period of time, the pressure in the first and second volumes 131 and 132 will equalize as fluid passes through flow restrictor 140.

Figure 3A:
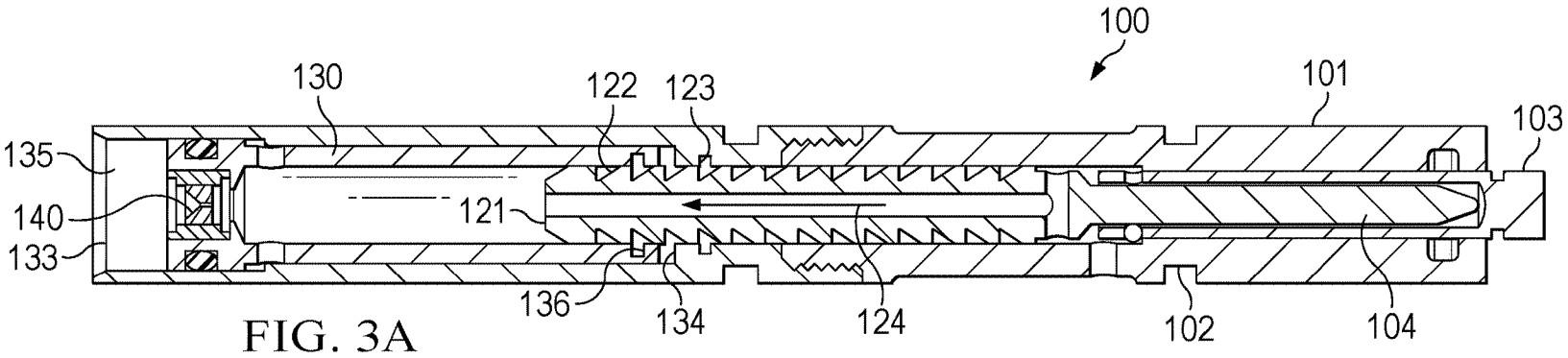
FIG. 3A depicts a multi-cycle counter system in accordance with an embodiment, with a piston at the end of a stroke distance in a direction opposite the activation direction.
Figure 3B:
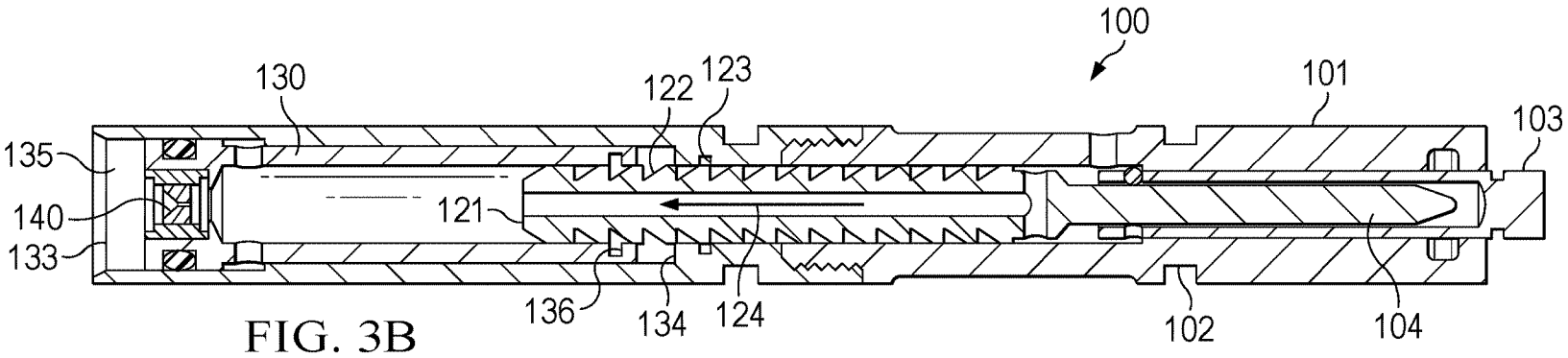
FIG. 3B depicts a multi-cycle counter system in accordance with an embodiment, with a piston in the middle of a stroke while moving in the activation direction.
Figure 3C:
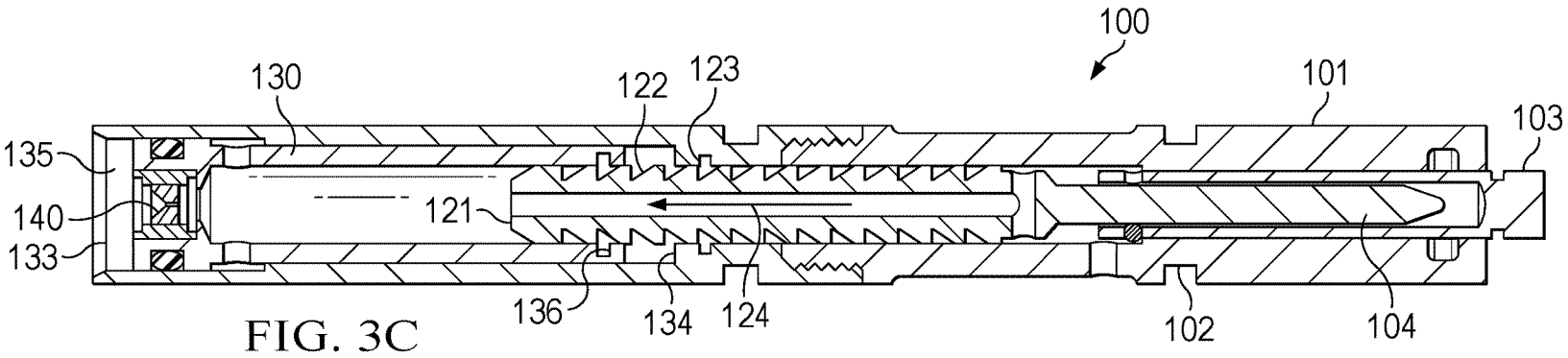
FIG. 3C depicts a multi-cycle counter system in accordance with an embodiment, with a piston at the end of a stroke distance in the activation direction.

FIGS. 3A-C depict the piston 130 pulling the ratchet rod 121 in the activation direction 124. When the additional pressure is removed from the fluid source 135, the piston 130 will begin to move in the activation direction 124. As the piston moves, the clip 136 on the piston 130 will grip the ratchet rod 121, and pull the ratchet rod 121 in the activation direction 124. FIG. 3B shows the piston 130 in mid-stroke, showing that the clip 126 of the counter mechanism 120 slides over the ratchet tooth 122, while the clip 136 pulls the ratchet rod in the activation direction 124. As depicted in FIG. 3C, the piston will come to rest once it reaches the travel stop 134 (not depicted, but shown in FIG. 1). After a period of time, the pressure in the first and second volumes 131 and 132 will equalize as fluid passes through flow restrictor 140.

Figure 4A:
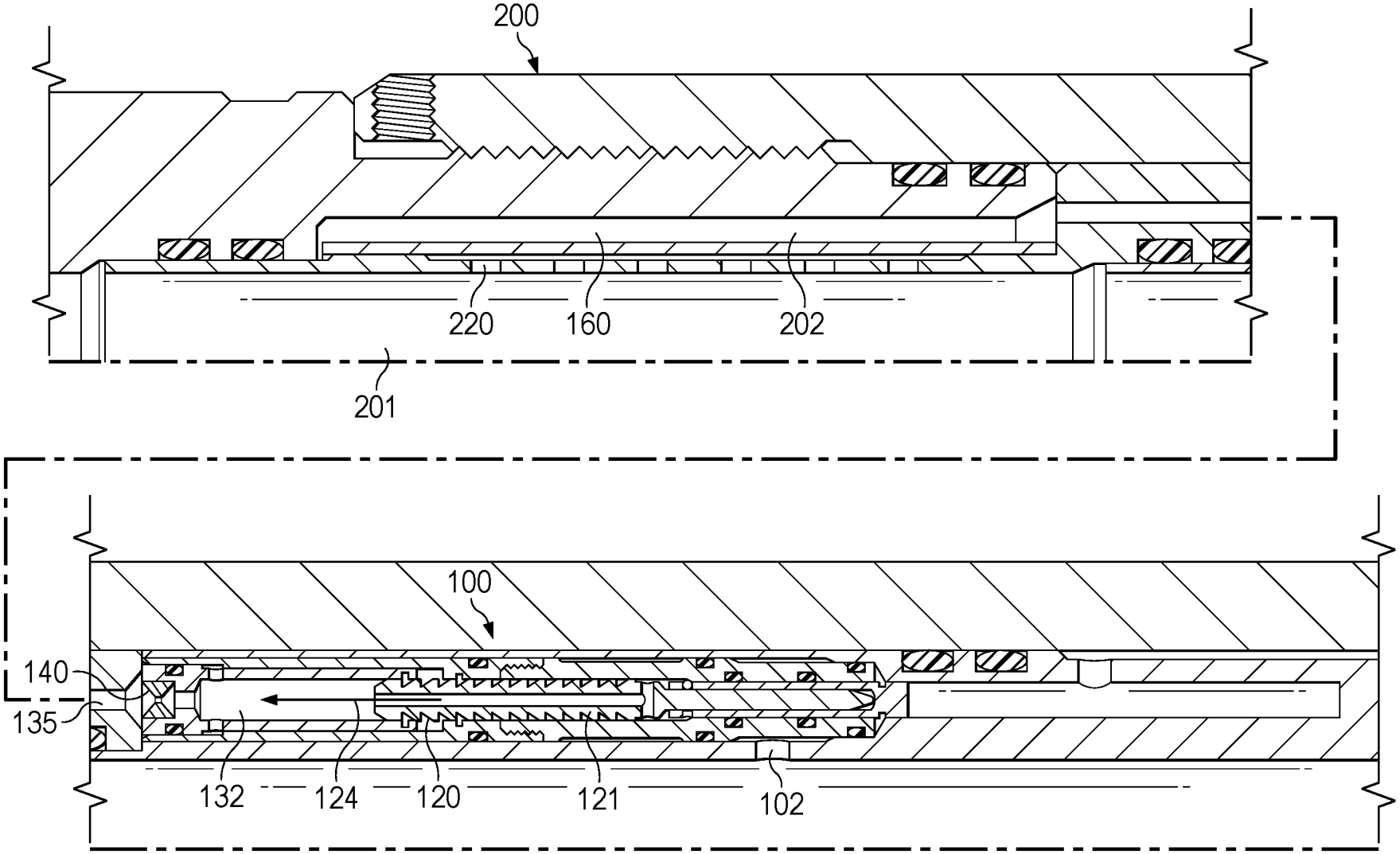
FIG. 4A is a cross-sectional diagram multi-cycle counter system installed in a downhole tool in accordance with an embodiment, with a relatively low wellbore pressure.

FIGS. 4A-10B depict a complete cycle and opening of a multi-cycle counter system 100 in accordance with embodiments. FIG. 4A shows a cross-section of a multi-cycle counter system 100 installed in a downhole tool 200. The downhole tool 200 has a fluid passageway 210 filled with a wellbore fluid. In this embodiment, a baffle 220 separates the wellbore fluid 201 from an activation fluid 202 in the multi-cycle counter system 100. The baffle 220 serves as a flexible fluid barrier between the multi-cycle counter system 100 and the wellbore fluid 201, allowing pressures applied to the wellbore fluid 201 to be transmitted to the activation fluid 202. In some embodiments, the presence of the baffle 220 prevents debris and impurities from the wellbore fluid from fouling the multi-cycle counter system 100, and permits the use of a different fluid for the activation fluid 202, such as a fluid having a different compressibility than the wellbore fluid 201. Behind the baffle 220 is a fluid activation reservoir 160 in fluid connection with a fluid source port 135 of the multi-cycle counter system 100. FIG. 4B is a cross-section diagram of the multi-cycle counter system 100, shown 90 degrees to the cross section in FIG. 4A, illustrating a fluid reservoir 150 in fluid communication with the second volume 132 of the piston 130. In FIGS. 4A-4B, the wellbore fluid and the activation fluid are at a relatively low pressure, such as a hydrostatic pressure at a location in a wellbore. This relative low pressure is depicted in blue.

Figure 4B:
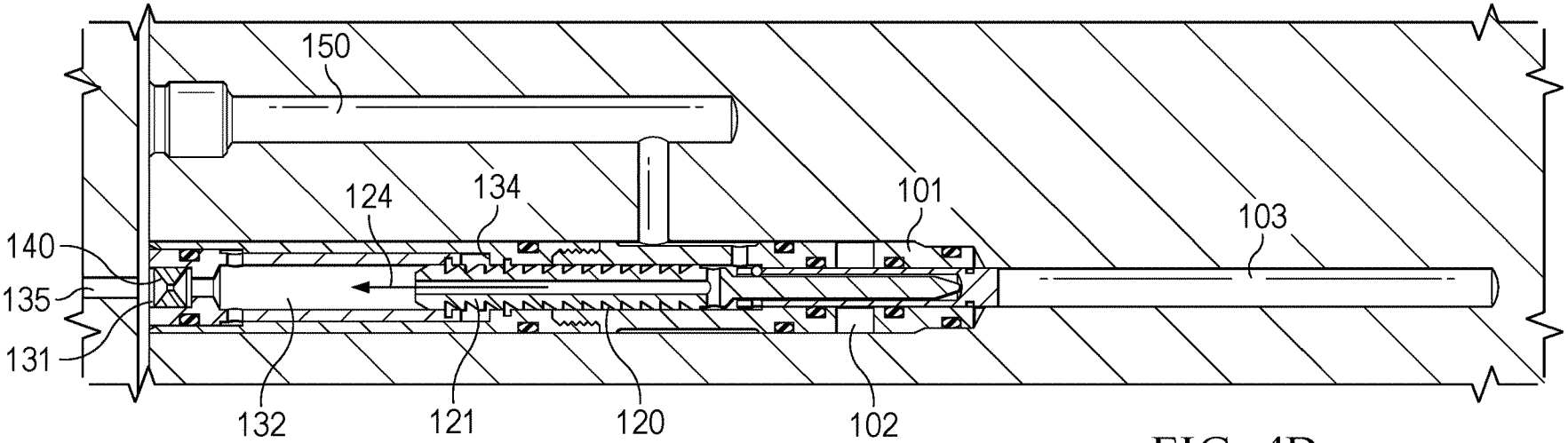
FIG. 4B is a cross-sectional diagram of the multi-cycle counter system installed in a downhole tool of FIG. 4A, showing a cross-section 90 degrees from that shown in FIG. 4A.
Figure 5A:
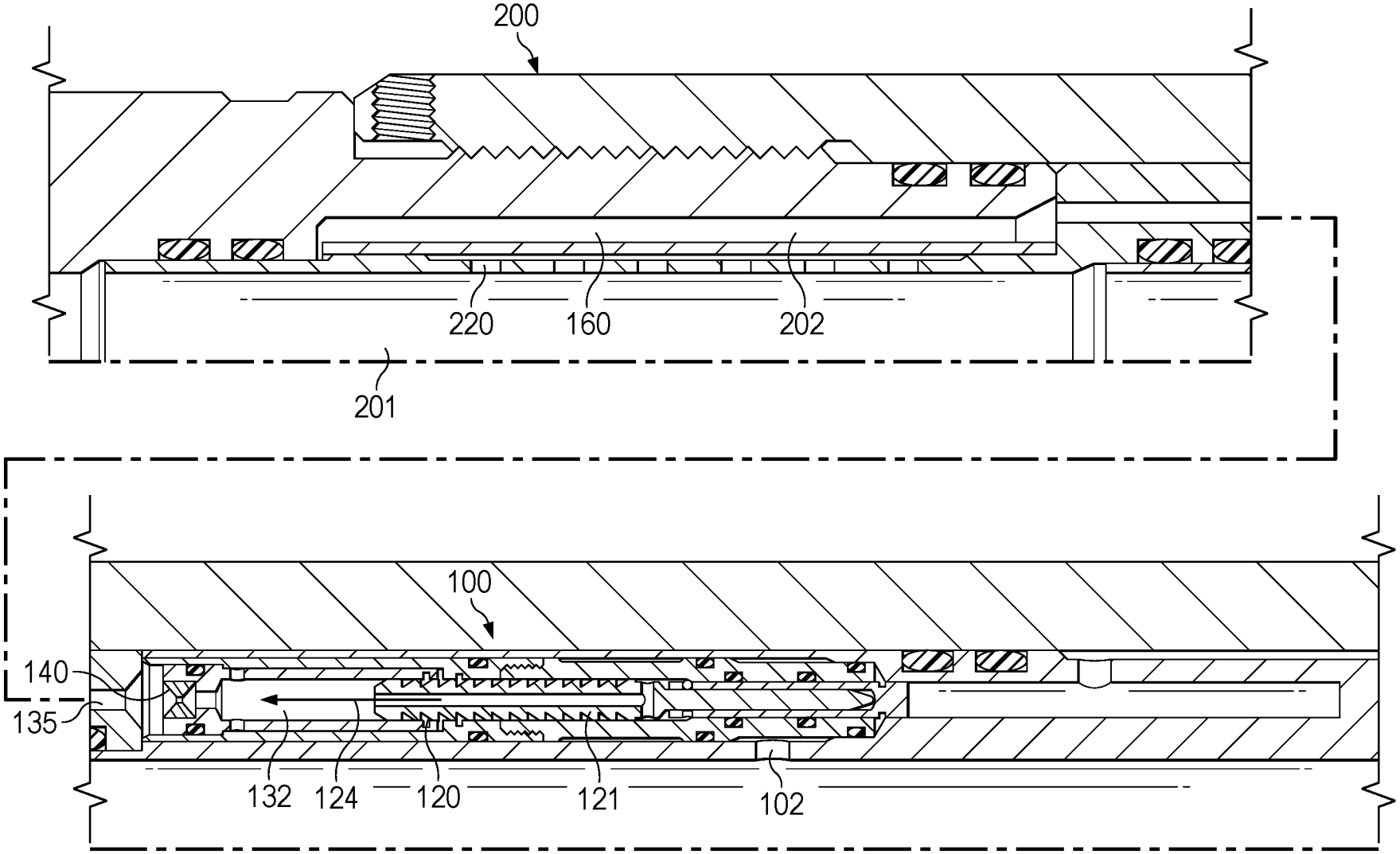
FIG. 5A is a cross-sectional diagram multi-cycle counter system installed in a downhole tool in accordance with an embodiment, shortly after a relatively high wellbore pressure is applied to the multi-cycle counter system.
Figure 5B:
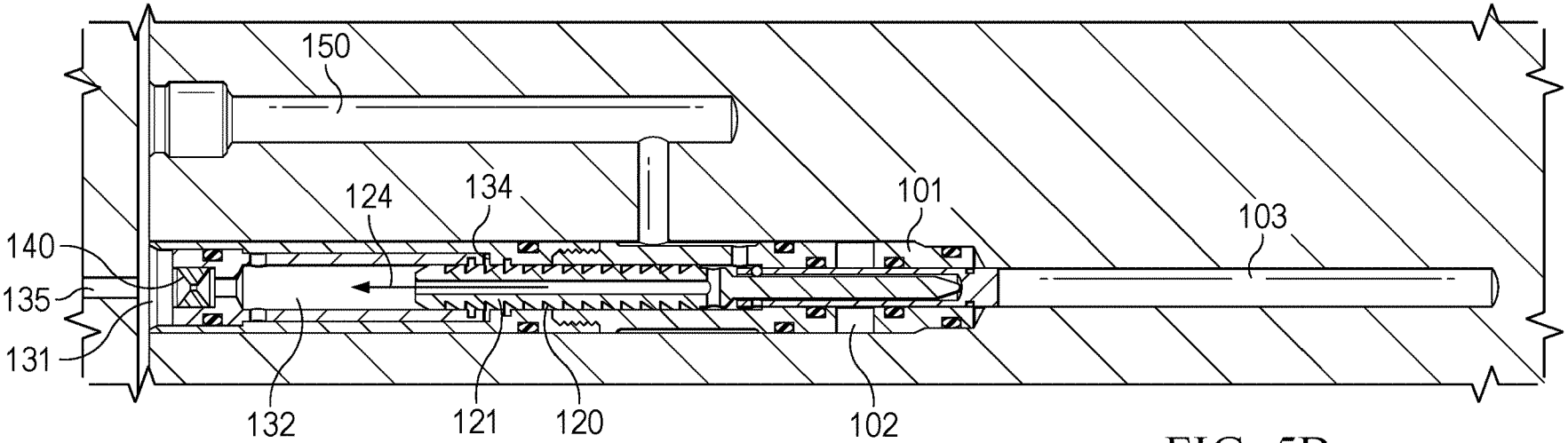
FIG. 5B is a cross-sectional diagram of the multi-cycle counter system installed in a downhole tool of FIG. 5A, showing a cross-section 90 degrees from that shown in FIG. 5A.

FIGS. 5A-5B shows the same cross-sections of FIGS. 4A-4B shortly after a relatively higher pressure has been applied to the wellbore fluid, such as by applying pressure from the surface. This higher pressure is depicted in red. The higher pressure in the wellbore fluid is transmitted via the baffle to the fluid source port 135, and into the first volume 131. Because the pressure is higher in the first volume 131 than the second volume 132, the piston 130 moves in the opposite direction from the activation direction 124. The clip 135 of the piston 130 slides over a ratchet tooth 122 of the ratchet rod 121.

Figure 6A:
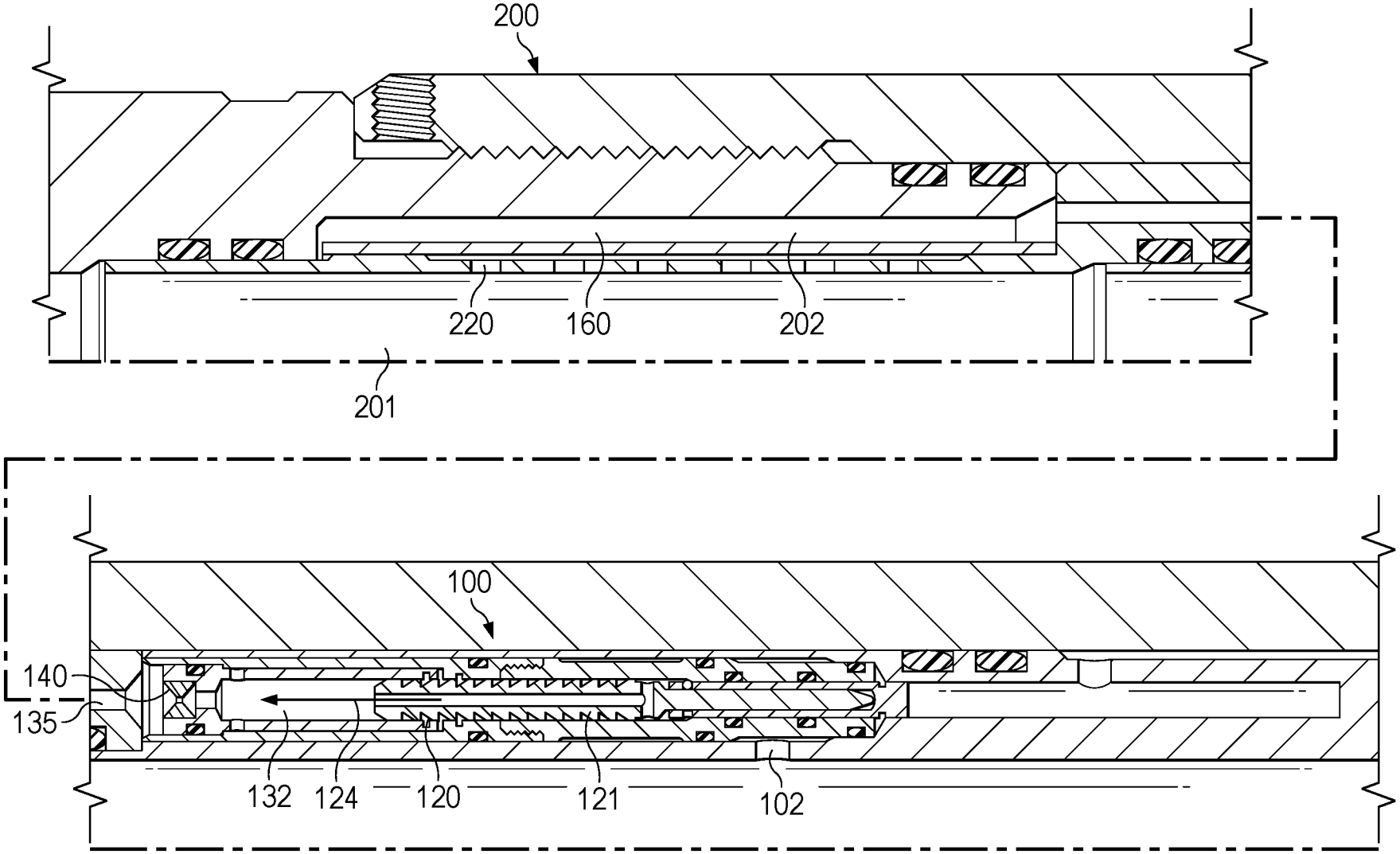
FIG. 6A is a cross-sectional diagram multi-cycle counter system installed in a downhole tool in accordance with an embodiment, after a relatively high wellbore pressure has been applied, and pressure has equalized through a flow restrictor.
Figure 6B:
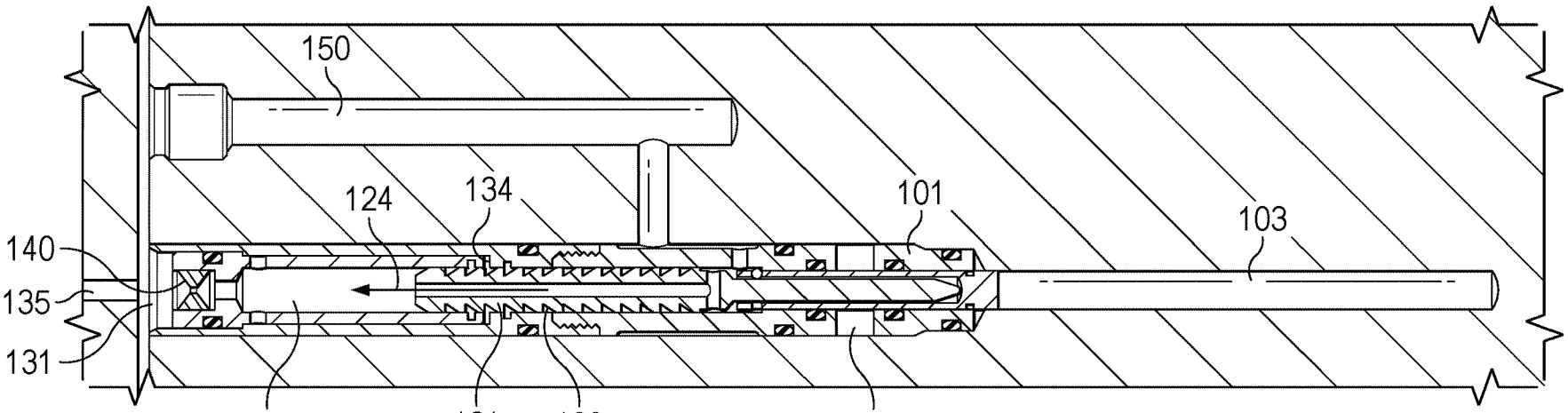
FIG. 6B is a cross-sectional diagram of the multi-cycle counter system installed in a downhole tool of FIG. 6A, showing a cross-section 90 degrees from that shown in FIG. 6A.

FIGS. 6A-6B show the same cross-sections of FIGS. 5A-5B after the relatively higher pressure has been applied to the wellbore fluid, and after sufficient time has passed for the high pressure activation fluid to flow through the flow restrictor 140 from the first volume 131 to the second volume 132. In this state, the fluid pressure in the first and second volumes 131, 132 are approximately equivalent.

Figure 7A:
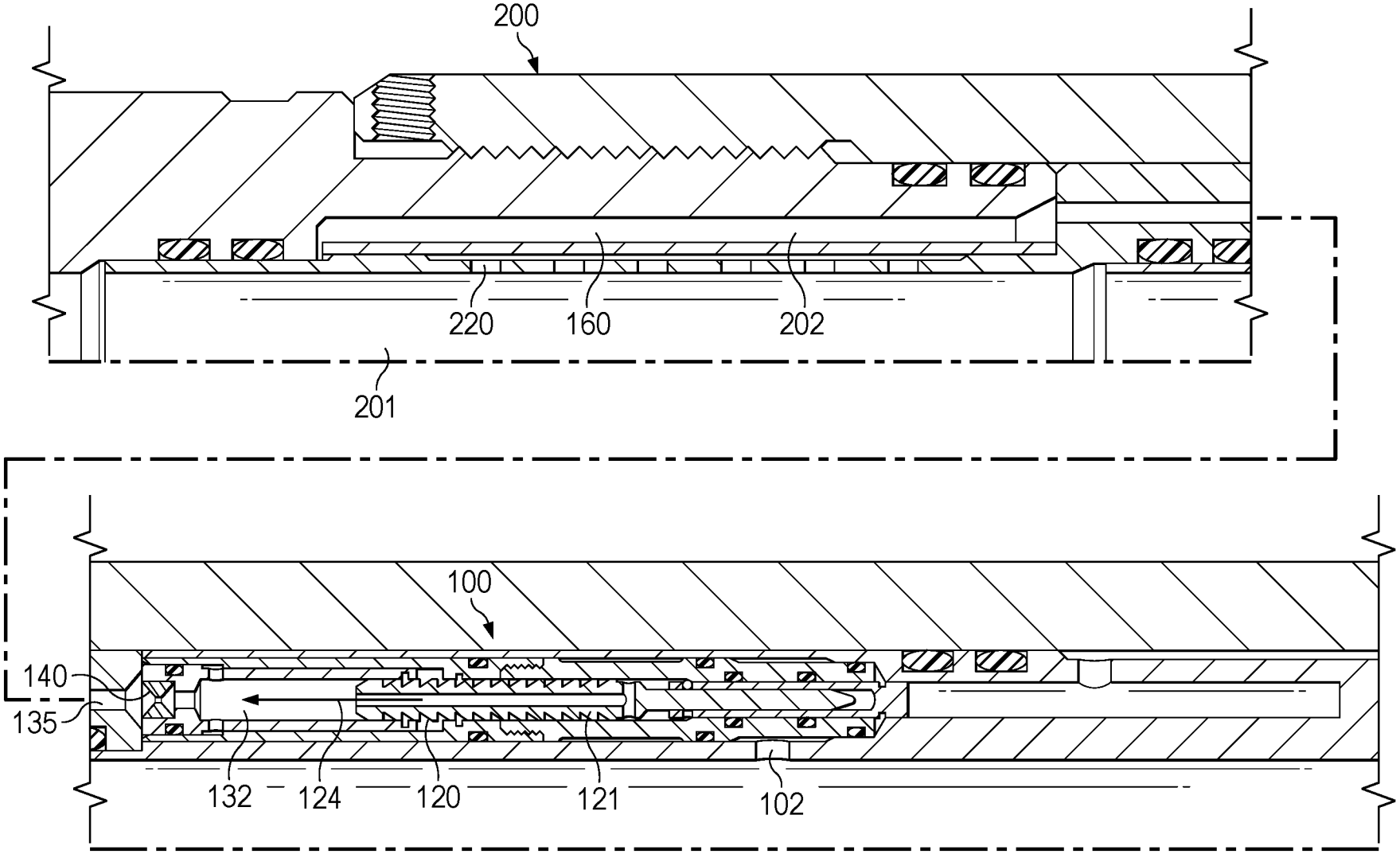
FIG. 7A is a cross-sectional diagram multi-cycle counter system installed in a downhole tool in accordance with an embodiment, shortly after a relatively low wellbore pressure is applied to the multi-cycle counter system.
Figure 7B:
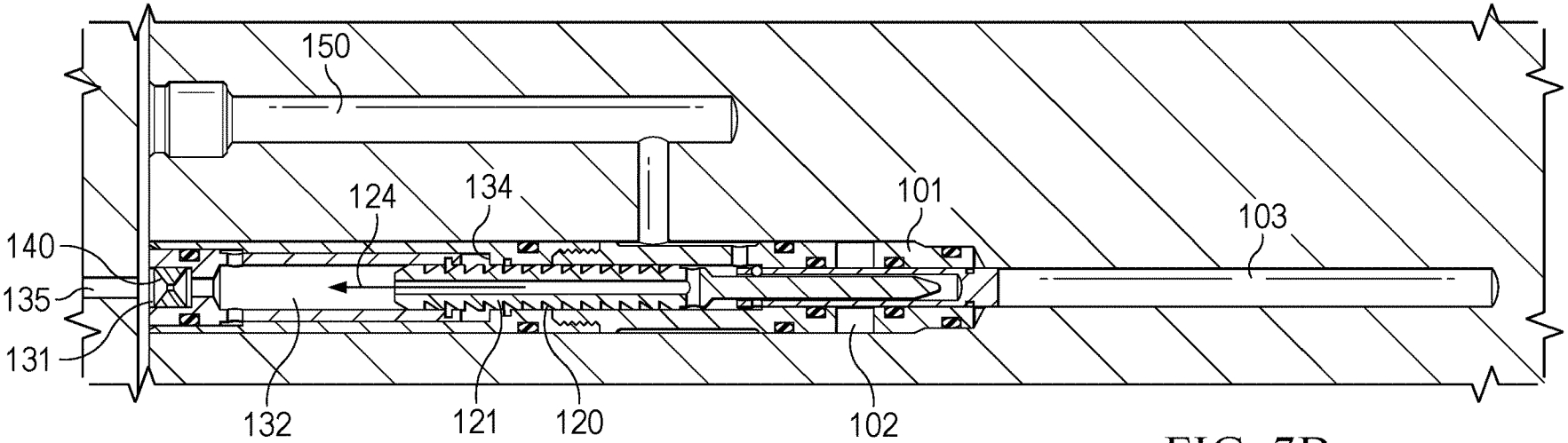
FIG. 7B is a cross-sectional diagram of the multi-cycle counter system installed in a downhole tool of FIG. 7A, showing a cross-section 90 degrees from that shown in FIG. 7A.

FIGS. 7A-7B show the same cross-sections of FIGS. 6A-6B shortly after the relatively higher pressure has been removed from the wellbore fluid, returning the wellbore fluid to a relatively lower pressure. In this state, the pressure in the second volume 132 is greater than the pressure in the first volume 131, causing the piston to move in the activation direction, pulling the ratchet rod a step distance in the activation direction.

Figure 8A:
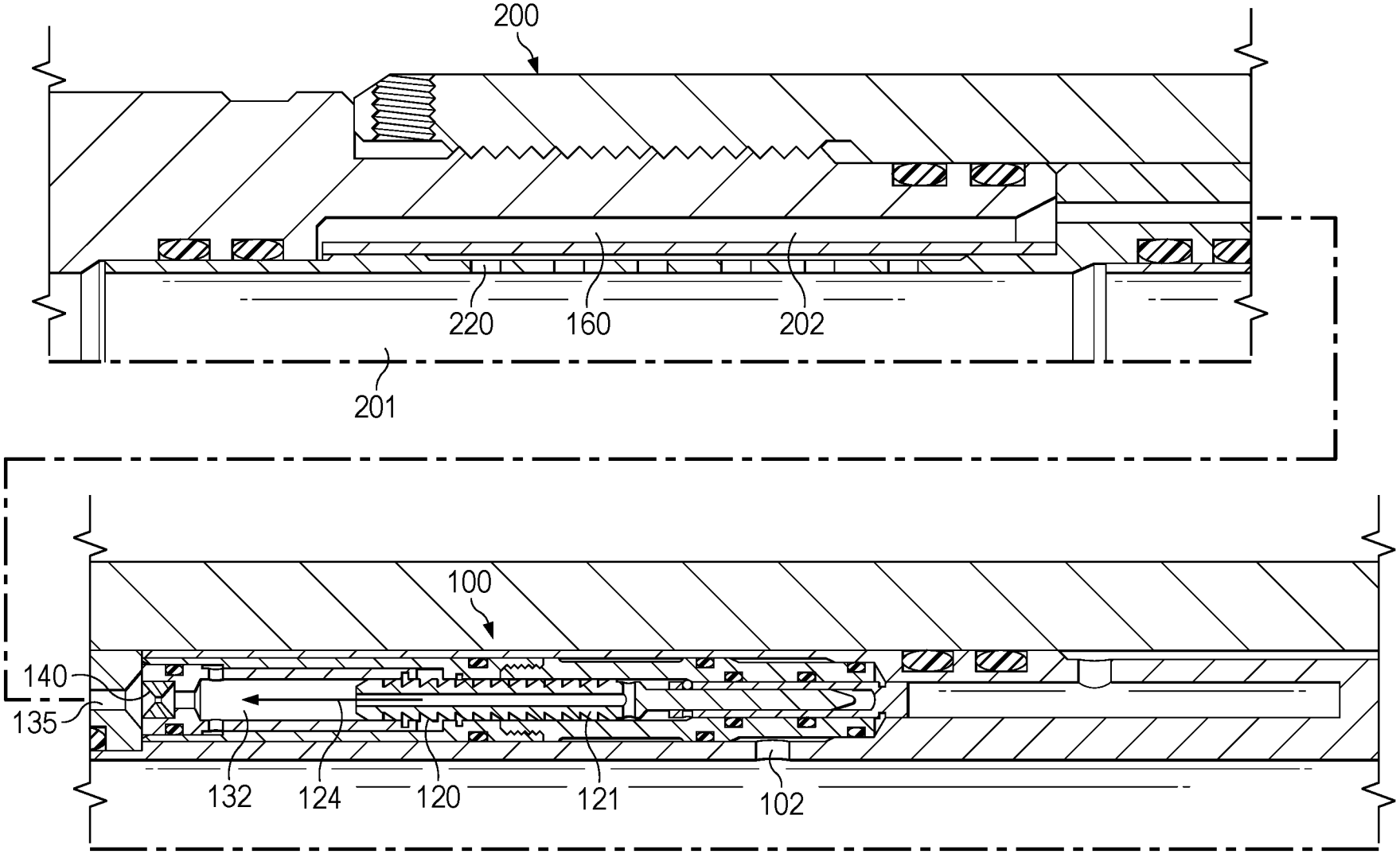
FIG. 8A is a cross-sectional diagram multi-cycle counter system installed in a downhole tool in accordance with an embodiment, after a relatively low wellbore pressure has been applied, and pressure has equalized through a flow restrictor.
Figure 8B:
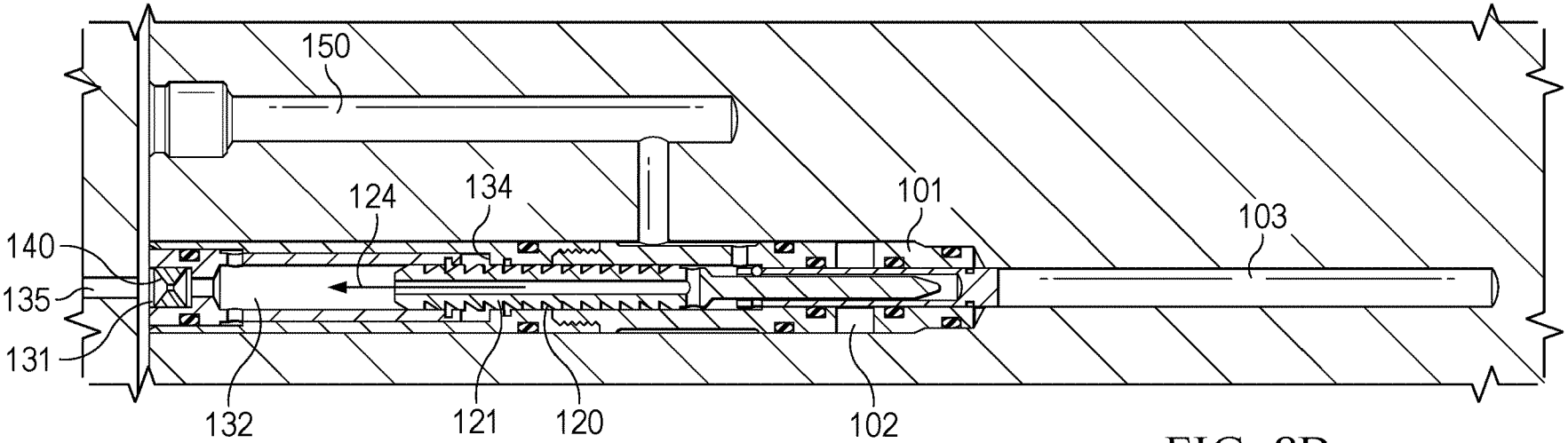
FIG. 8B is a cross-sectional diagram of the multi-cycle counter system installed in a downhole tool of FIG. 8A, showing a cross-section 90 degrees from that shown in FIG. 8A.

FIGS. 8A-8B show the same cross-sections of FIGS. 7A-7B after the relatively higher pressure has been removed from the wellbore fluid, and after sufficient time has passed for the high pressure activation fluid to flow through the flow restrictor 140 from the second volume 132 to the first volume 131. Once the steps depicted in FIGS. 4A-8B have been completed, a single cycle of the multi-cycle counter system 100 has been completed.

Figure 9A:
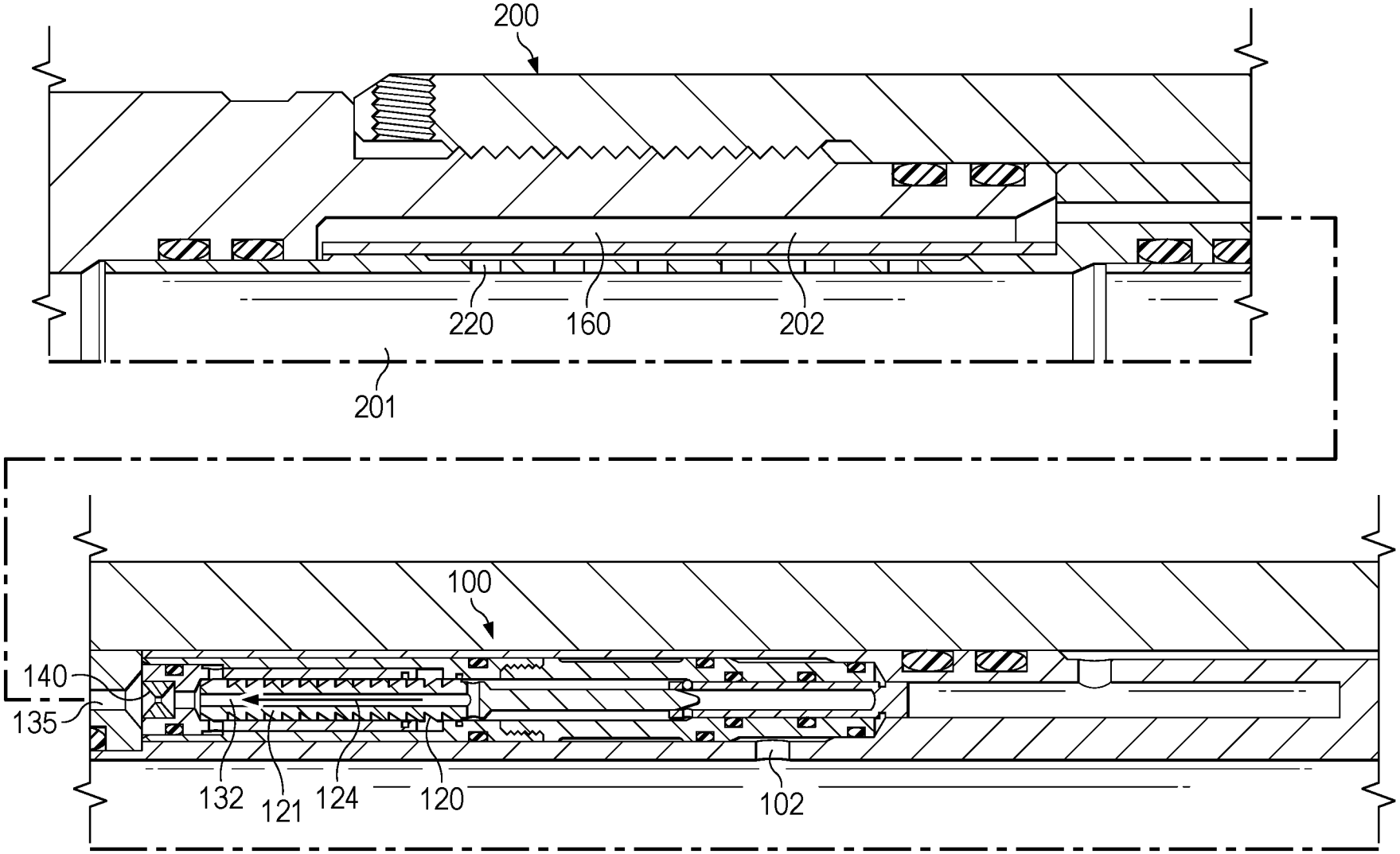
FIG. 9A is a cross-sectional diagram multi-cycle counter system installed in a downhole tool in accordance with an embodiment, after a relatively low wellbore pressure has been applied, and pressure has equalized through a flow restrictor, and after the last cycle of the multi-cycle counter system has been completed, and the pin valve is opened.
Figure 9B:
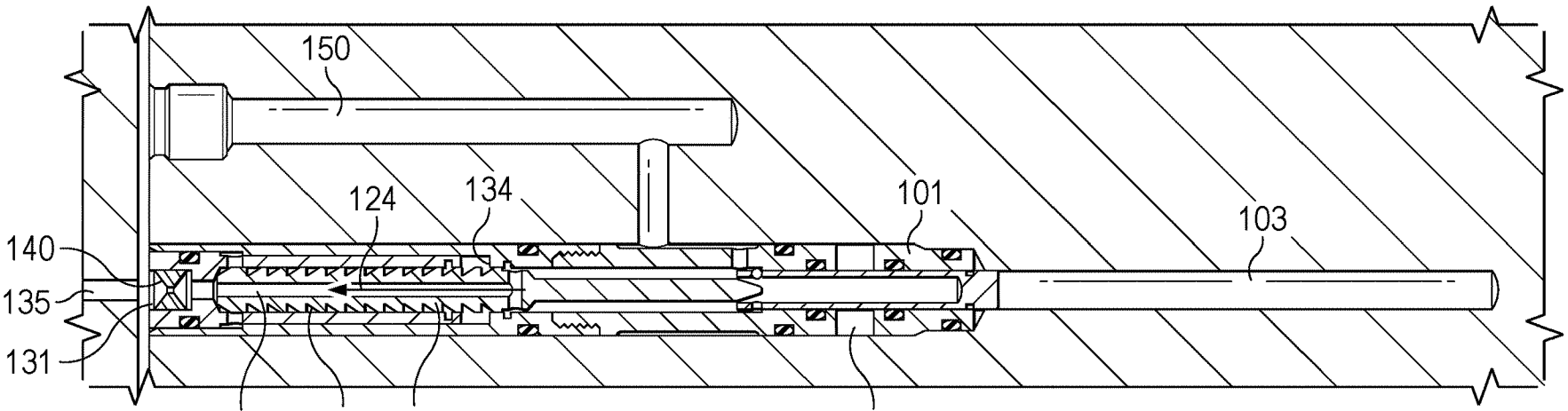
FIG. 9B is a cross-sectional diagram of the multi-cycle counter system installed in a downhole tool of FIG. 9A, showing a cross-section 90 degrees from that shown in FIG. 9A.
Figure 10A:
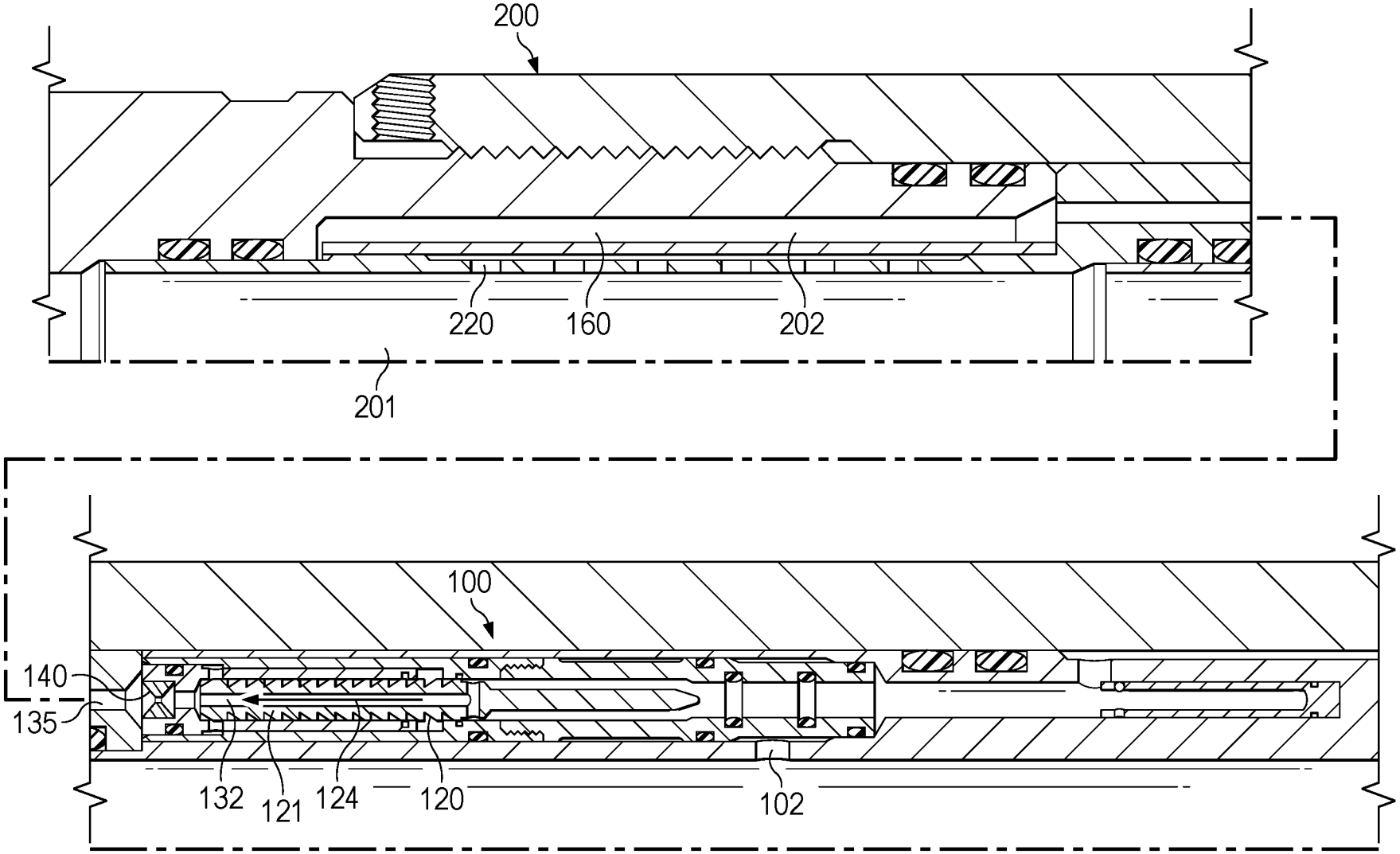
FIG. 10A is a cross-sectional diagram multi-cycle counter system installed in a downhole tool in accordance with an embodiment, after a relatively low wellbore pressure has been applied, and pressure has equalized through a flow restrictor, and after the last cycle of the multi-cycle counter system has been completed, the pin valve is opened, and wellbore fluid is allowed to pass through the pin valve into the activation port.
Figure 10B:
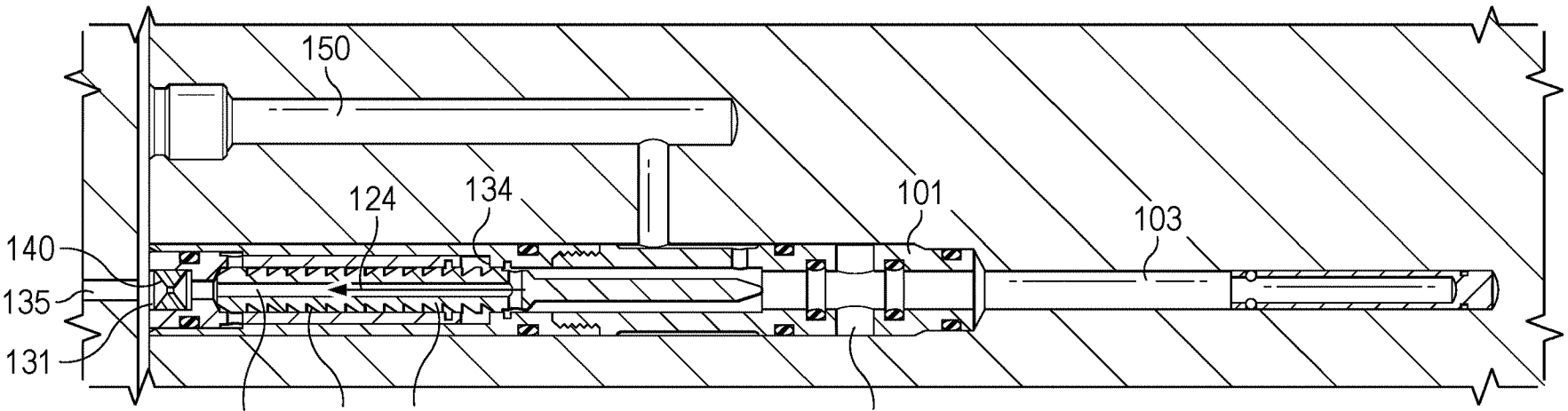
FIG. 10B is a cross-sectional diagram of the multi-cycle counter system installed in a downhole tool of FIG. 10A, showing a cross-section 90 degrees from that shown in FIG. 10A.

FIGS. 9A-9B show the same cross-sections of FIGS. 8A-8B after the multi-cycle counter system 100 has completed a sufficient number of activation cycles such that the ratchet rod has moved the activation distance, causing the pin 104 to be pulled completely out of pin valve 101. In this state, the valve 101 has an open fluid passageway to allow a fluid (in this case, wellbore fluid) to pass through the pin valve 101 and into the activation port 103. FIGS. 10A-B show the same cross-sections of FIGS. 9A-9B, showing wellbore fluid passing through pin valve 101 and into activation port 103.

The person skilled in the art realizes that the present invention is not limited to the preferred embodiments described above. The person skilled in the art further realizes that modifications and variations are possible within the scope of the appended claims. Additionally, variations to the disclosed embodiments can be understood and effected by the skilled person in practicing the claimed invention, from a study of the drawings, the disclosure, and the appended claims.

What is claimed is:

1. A downhole tool activation device, comprising:

a valve disposed between a pressurized fluid and an activation port, a counter device connected to the valve, wherein the valve is configured to open when the counter device has moved an activation distance in an activation direction, a piston engaged with the counter device, having a wellbore pressure from a fluid source applied to a first side, and a pressure in a fluid reservoir applied to the second side, the piston configured to move a step distance in a first direction when the wellbore pressure exceeds the pressure in the fluid reservoir, and configured to move a step distance in an opposite direction driven solely by a greater pressure in the fluid reservoir than the wellbore pressure, and a flow restrictor in fluid communication with the fluid reservoir and fluid source, configured to restrict the flow of fluid between the fluid source to the fluid reservoir, wherein the fluid source is a second fluid reservoir separated from the wellbore fluid by a barrier configured to allow pressures applied to the wellbore fluid to be transmitted by the barrier to the second fluid reservoir.

2. The downhole tool activation device of claim 1, wherein the flow restrictor is further configured to:

allow a pressure applied to the wellbore fluid to move the piston the step distance in the first direction before sufficient fluid passes through the flow restrictor to equalize the pressure between the fluid source and the fluid reservoir, and allow the piston to move the step distance in the opposite direction when the pressure is released from the wellbore fluid before sufficient fluid passes through the flow restrictor to equalize the pressure between the fluid source and the fluid reservoir.

3. The downhole tool activation device of claim 1, wherein a fluid in the fluid reservoir and the second fluid reservoir has a higher compressibility than the wellbore fluid.

4. The downhole tool activation device of claim 1, wherein the valve is a pin valve, and wherein a pathway is selectively blocked by a pin such that when the pin is removed from the pin valve, the pressurized fluid can pass through the pin valve to the activation port.

5. The downhole tool activation device of claim 4, wherein the pin is connected to the counter device, and wherein the pin is removed from the pin valve when the counter device has moved the activation distance.

6. The downhole tool activation device of claim 1, wherein the step distance is half the activation distance or less.

7. The downhole tool activation device of claim 1, wherein the counter device is a ratchet rod having a plurality of ratchet teeth, the piston having a first ratchet gripping device allowing the ratchet rod to travel only one direction relative to the piston, and a second ratchet gripping device fixed relative to the downhole tool, allowing the ratchet rod to travel only one direction through the second ratchet gripping device.

8. The downhole tool activation device of claim 7, wherein the ratchet rod is moved a distance greater than or equal to the length of a ratchet tooth on the ratchet rod when the piston is moved the step distance.

9. The downhole tool activation device of claim 1, wherein movement of the piston in the first direction and opposite direction is limited by travel stops.

10. A method of using a downhole tool activation device, comprising:

wherein the downhole tool activation device comprises:

a valve disposed between a pressurized fluid and an activation port, a counter device connected to the valve, wherein the valve is configured to open when the counter device has moved an activation distance in an activation direction, a piston engaged with the counter device, having a wellbore pressure from a fluid source applied to a first side, and a pressure in a fluid reservoir applied to the second side, the piston configured to move a step distance in a first direction when the wellbore pressure exceeds the pressure in the fluid reservoir, and configured to move a step distance in an opposite direction driven solely by a greater pressure in the fluid reservoir than the wellbore pressure, a flow restrictor in fluid communication with the fluid reservoir and fluid source, configured to restrict the flow of fluid between the fluid source to the fluid reservoir and wherein the method comprises:

increasing the wellbore pressure, causing the pressure from the fluid source to move the piston the step distance in a first direction, lowering the wellbore pressure, causing the pressure from the fluid reservoir to move the piston the step distance in an opposite direction, wherein the fluid source is a second fluid reservoir separated from the wellbore fluid by a barrier configured to allow pressures applied to the wellbore fluid to be transmitted by the barrier to the second fluid reservoir.

11. The method of claim 10, further comprising:

after increasing the wellbore pressure, and/or after lowering the wellbore pressure, maintaining the wellbore pressure for a period of time sufficient to allow fluid to flow through the flow restrictor and equalize the pressure between the fluid reservoir and the fluid source.

12. The method of claim 10, wherein the method is repeated a predetermined number of times until the counter device has moved the activation distance, causing the valve to open.

13. The method of claim 10, wherein a fluid in the fluid reservoir and the second fluid reservoir has a higher compressibility than the wellbore fluid.

14. The method of claim 10, wherein the valve is a pin valve, and wherein a pathway is selectively blocked by a pin such that when the pin is removed from the pin valve, the pressurized fluid can pass through the pin valve to the activation port.

15. The method of claim 14, wherein the pin is connected to the counter device, and wherein the pin is removed from the pin valve when the counter device has moved the activation distance.

16. The method of claim 10, wherein the counter device is a ratchet rod having a plurality of ratchet teeth, the piston having a first ratchet gripping device allowing the ratchet rod to travel only one direction relative to the piston, and a second ratchet gripping device fixed relative to the downhole tool, allowing the ratchet rod to travel only one direction through the second ratchet gripping device.

17. The method of claim 16, wherein the ratchet rod is moved a distance greater than or equal to the length of a ratchet tooth on the ratchet rod when the piston is moved the step distance.

18. The method of claim 10, wherein the step distance is half the activation distance, or less.

19. A downhole tool activation device, comprising:

a valve disposed between a pressurized fluid and an activation port, a counter device connected to the valve, wherein the valve is configured to open when the counter device has moved an activation distance in an activation direction, a piston engaged with the counter device, having a wellbore pressure from a fluid source applied to a first side, and a pressure in a fluid reservoir applied to the second side, the piston configured to move a step distance in a first direction when the wellbore pressure exceeds the pressure in the fluid reservoir, and configured to move a step distance in an opposite direction driven solely by a greater pressure in the fluid reservoir than the wellbore pressure, and a flow restrictor in fluid communication with the fluid reservoir and fluid source, configured to restrict the flow of fluid between the fluid source to the fluid reservoir, wherein the valve is a pin valve, and wherein a pathway is selectively blocked by a pin such that when the pin is removed from the pin valve, the pressurized fluid can pass through the pin valve to the activation port.

20. The downhole tool activation device of claim 19, wherein the pin is connected to the counter device, and wherein the pin is removed from the pin valve when the counter device has moved the activation distance.

21. A method of using a downhole tool activation device, comprising:

wherein the downhole tool activation device comprises:

a valve disposed between a pressurized fluid and an activation port, a counter device connected to the valve, wherein the valve is configured to open when the counter device has moved an activation distance in an activation direction, a piston engaged with the counter device, having a wellbore pressure from a fluid source applied to a first side, and a pressure in a fluid reservoir applied to the second side, the piston configured to move a step distance in a first direction when the wellbore pressure exceeds the pressure in the fluid reservoir, and configured to move a step distance in an opposite direction driven solely by a greater pressure in the fluid reservoir than the wellbore pressure, a flow restrictor in fluid communication with the fluid reservoir and fluid source, configured to restrict the flow of fluid between the fluid source to the fluid reservoir and wherein the method comprises:

increasing the wellbore pressure, causing the pressure from the fluid source to move the piston the step distance in a first direction, lowering the wellbore pressure, causing the pressure from the fluid reservoir to move the piston the step distance in an opposite direction, wherein the valve is a pin valve, and wherein a pathway is selectively blocked by a pin such that when the pin is removed from the pin valve, the pressurized fluid can pass through the pin valve to the activation port.

22. The method of claim 21, wherein the pin is connected to the counter device, and wherein the pin is removed from the pin valve when the counter device has moved the activation distance.

* * * * *